US005213394A

United States Patent [19]

Tattrie

[11] Patent Number: 5,213,394

[45] Date of Patent: May 25, 1993

[54] MOLDED RECLINER ROCKER CHAIR

[76] Inventor: Newton Tattrie, 400 Moorland Dr., Virginia Beach, Va. 23452

[21] Appl. No.: 420,421

[22] Filed: Oct. 12, 1989

Related U.S. Application Data

[63] Continuation of Ser. No. 342,053, Apr. 24, 1989, abandoned.

[51] Int. Cl.[5] ..... A47C 3/02

[52] U.S. Cl. ..... 297/258; 297/272; 297/188; 297/457; 297/DIG. 2

[58] Field of Search ..... 297/188, 194, 258, 313, 297/314, 457–460, DIG. 1, DIG. 2, 272; 248/138

[56] References Cited

U.S. PATENT DOCUMENTS

| | | | |
|---|---|---|---|
| D. 168,270 | 11/1952 | Lamb | D6/348 |
| D. 176,045 | 11/1955 | Sherman | D6/361 |
| D. 194,497 | 2/1963 | Miller | D6/361 |
| D. 194,498 | 2/1963 | Miller | D6/361 |
| D. 196,430 | 10/1963 | Andre et al. | D6/348 |
| D. 209,446 | 12/1967 | Delieuvin . | |
| D. 210,875 | 4/1968 | Stauber et al. | D6/361 |
| D. 218,889 | 10/1970 | Lamb | D6/361 |
| D. 392,105 | 10/1988 | Chapman | 248/138 X |
| 888,387 | 5/1908 | Clemons | 297/272 |
| 2,544,800 | 3/1951 | Michaelis | 297/328 |
| 2,808,875 | 10/1957 | Bargen | 297/457 |
| 2,930,430 | 3/1960 | Bloom | 297/457 |
| 3,102,280 | 9/1963 | Williams . | |
| 3,117,327 | 11/1964 | Mathew . | |
| 3,317,244 | 5/1967 | Ferro . | |
| 3,620,570 | 11/1971 | Wilson | 297/448 |
| 3,860,976 | 11/1975 | Suyama | 4/185 B |
| 4,109,960 | 8/1978 | Stinchfield | 297/258 |
| 4,367,870 | 1/1983 | Birch | 297/258 |
| 4,418,958 | 12/1983 | Watkin | 297/457 |
| 4,564,240 | 1/1986 | Thieme | 297/457 |
| 4,752,067 | 6/1988 | Colonello | 272/93 |

*Primary Examiner*—Peter R. Brown
*Attorney, Agent, or Firm*—Jim Zegeer

[57] ABSTRACT

A molded reclining rocker chair having a continuous body support panel with a head torso supporting portion smoothly joined to a rump and thigh supporting panel portion which, in turn, is smoothly connected to a leg and foot supporting panel portion. A pair of depending side rocker panels begin at the outermost tip of the head and torso panel portion and extend along the sides of the panel portions to smoothly and curvingly diverge from the outermost tip to proximate the beginning of the rump and thigh portion to form a concave side panel and a further shallow convexly curved portion leading to the tip of the leg and foot supporting panel portions. A runner is integrally molded to the lower edge of each side panel and a brace member extends between the side panels at the rump supporting portion of the thigh portion. The runner portion is thickened in the area of the concave rocker side panel to modify the radius of curvature thereof and strengthen the rocker runner at the point of most radial loading, pressure and wear. In addition, it makes it easier to shift from reclining to sitting position and vice versa. Snap fasteners or VELCRO fasteners for pads and pillows are provided and a swivelled or gimballed cup holder is utilized on the panel side. Hand-holds are also provided. Slotted panels allow air flow through head and torso and leg and foot panels. The construction is preferably made out of fiberglass because it is more resistant to cracking.

18 Claims, 2 Drawing Sheets

FIG. 5
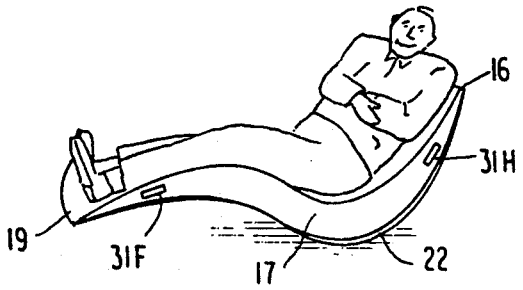
FIG. 6
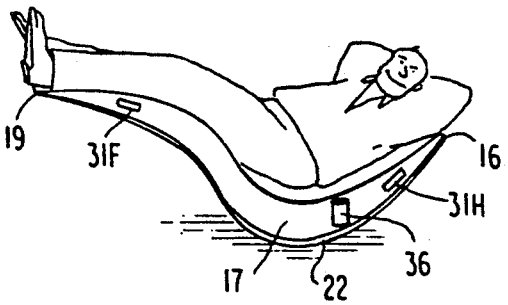
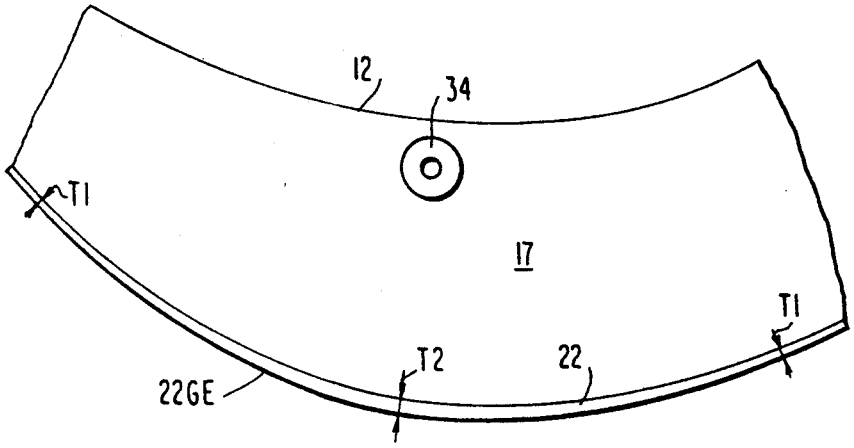
FIG. 4
FIG. 8
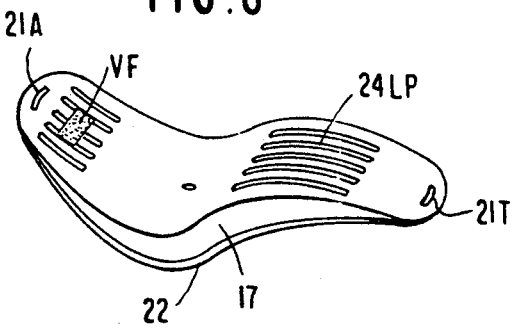
FIG. 7
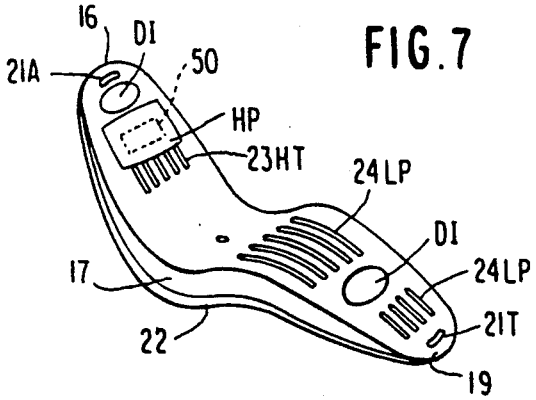
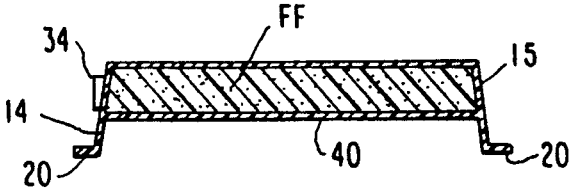
FIG. 9

MOLDED RECLINER ROCKER CHAIR

This is a continuation of application Ser. No. 06/342,053, filed Apr. 24, 1989, now abandoned.

BACK AND BRIEF DESCRIPTION OF THE INVENTION

The general configuration of the rocker recliner disclosed herein is known in the art. For example, a molded reclining chair having a continuous body support panel with the body support panel having a head and torso supporting panel portion smoothly joined to a rump and thigh supporting panel portion which, in turn, is smoothly connected to a leg and foot supporting panel portion is known. In such known construction, the leg and foot supporting panel portion is joined to the rump and thigh supporting panel portion an obtuse angle ($\theta$), with the head and torso panel portion being joined to the rump and thigh panel portion at an angle approaching about 80 to 100 degrees. These angularities are well known in the art and are adapted to comfortably accommodate the human torso. See, for example, the beach chair shown in U.S. Pat. No. Des. 2,118,889, the rocking seat shown in U.S. Pat. No. Des. 196,430, the bouyant exercising device shown in Williams U.S. Pat. No. 3,102,280, the chaise lounge shown in U.S. Pat. No. Des. 168,270, the head rest for dental chair shown in U.S. Pat. No. 3,317,244 to Ferro, the chair shown in U.S. Pat. No. Des. 209,446, and the chaise chair shown in U.S. Pat. No. Des. 194,498.

In addition, the prior art discloses such a rocker recliner in which a pair of side rocker panels beginning at the outermost tip end of the head and torso panel portion and extending along the sides of the panel portions to smoothly and curvingly diverge from the outermost tip to proximate the beginning of the rump and thigh portion to form a concave rocker side panel with a further shallow convexly curved portion leading to the tip end and foot supporting panel portion with a rocker runner integrally molded to the lower edge of each side panel and a brace member extending between the side panels of the rump supporting portion and the thigh panel portion. In such prior art, the runner has a uniform thickness.

The point of curvature of the rocker and runner secured thereto at the point of curvature where the thigh and rump portion as well as the torso and head portion present the most weight which is bearing down on the runner causes excessive wear. According to the invention, the runner is thickened in the area of the concave rocker side panel to modify the radius of curvature thereof and makes rocker/recliner easier to use. The shift from reclining to sitting and vice versa is achieved by shifting the arms and head of the user to thereby change the center of gravity relative to the curvature of the rocker side panel. In addition, the entire construction is made lighter by providing air openings or vents and means forming at least one hand-hold and in the side panels proximate the head and torso side panels and/or in the head and torso panels themselves. Fastener means are secured to each of the side panels and pad means with coacting fastener means are provided. Moreover, a cup support means which is capable of maintaining a verticality of a cup and may be a swiveled gimballed cup support which is secured, by a velcro fastener, for example, or rivet, to the depending portion of one of the pair of side panels. The location of this gimballed support is important in that it is important that the cup or whatever container is supported in the cup support does not engage the ground. Hence, the support is positioned at a point above the rocker runner a predetermined distance. Foam flotation may be located inbetween the side panels at locations to maintain the head and torso above water to thereby provide a floating chaise lounge.

DETAILED DESCRIPTION OF THE DRAWINGS

The above and other objects, advantages and features of the invention will become more apparent when considered with the accompanying specification and attached drawings wherein.

Figure 3:
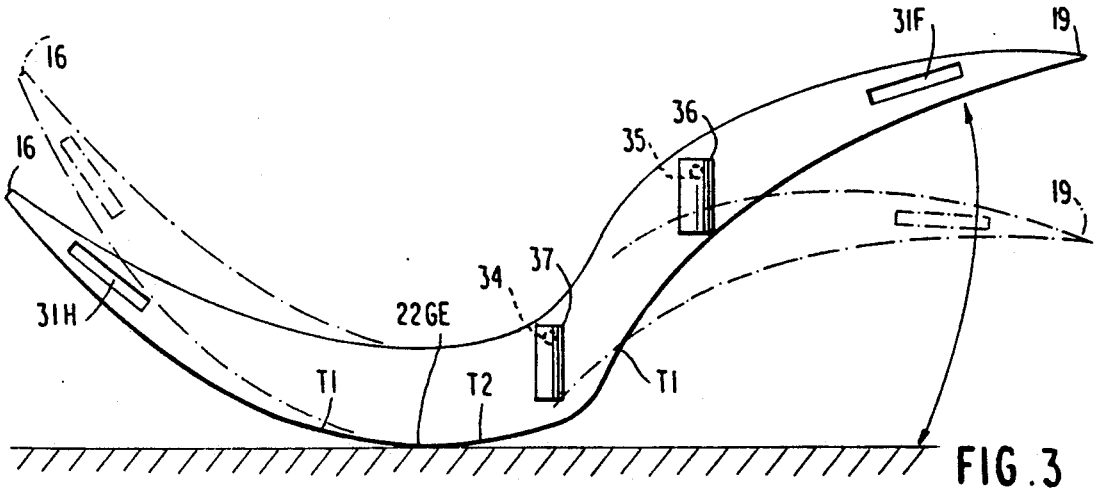

FIG. 3 is a further side elevation view thereof showing the invention in several different positions of use, FIG. 4 is an enlarged side elevational view showing the modifications applied to the rocker runner and ground engaging portion, FIGS. 5 and 6 illustrate the invention in use, FIGS. 7 and 8 illustrate the construction of the invention with fastener means for pads, pillows and the like, and FIG. 9 is a sectional view showing the flotation foam in the head and torso sections.

DETAILED DESCRIPTION OF THE INVENTION

Figure 1:
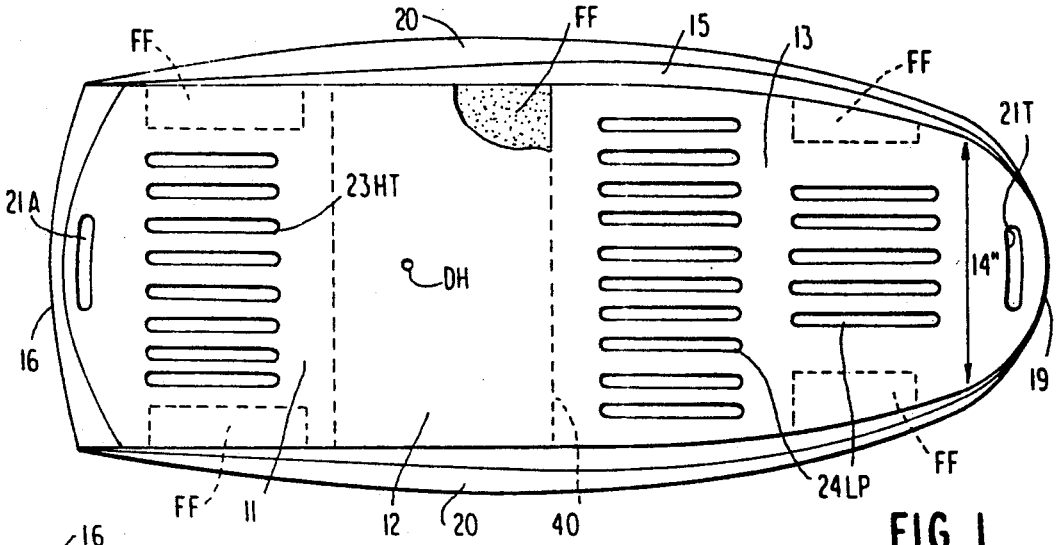
FIG. 1 is a top plan view of a rocker recliner incorporating the invention.
Figure 2:
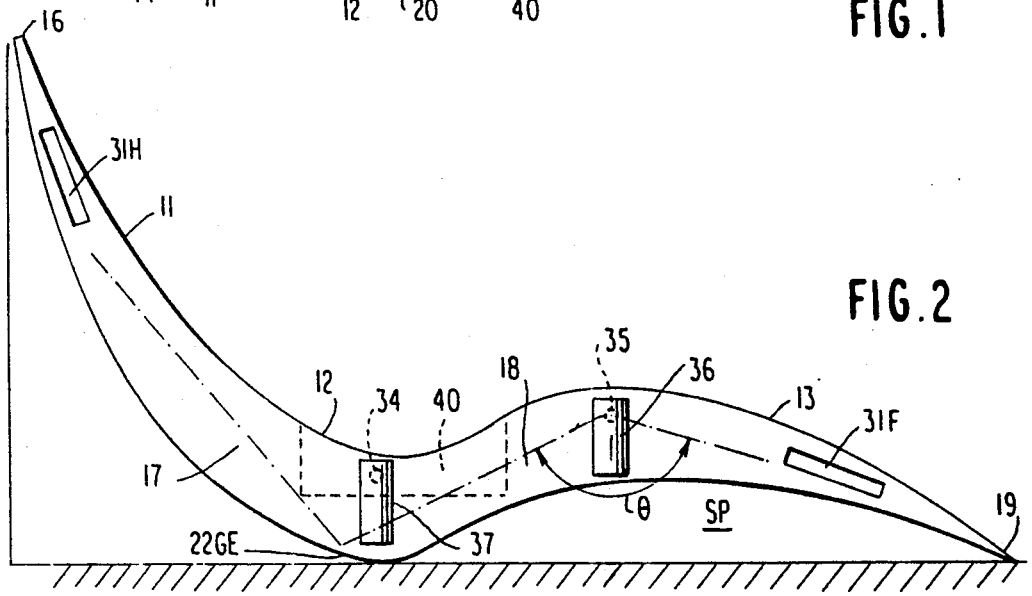
FIG. 2 is a side elevational view thereof.

As shown in FIGS. 1 and 2, the body supporting surface of the chaise lounge 10 incorporating the invention may be divided into three separate panel sections or elements, namely the head and torso supporting panel portion 11 smoothly joined to a rump and thigh supporting panel portion 12 which, in turn, is smoothly connected to a leg and foot supporting panel portion 13. The leg and foot supporting portion 13 is joined to the rump and thigh supporting portion at an obtuse angle ($\theta$) and the head and torso panel portion is joined to the rump and thigh panel portion at an angle approaching about 80 to 110 degrees. This configuration is well known in the prior art including the angular relationships recited. A pair of depending side rocker panels 14, 15 (which diverge downwardly so the units may be stacked) beginning at the outermost tip end 16 of the head and torso panel portion, each extending along the side edges of the panel portions to smoothly and curvingly diverge from the outermost tip 16 to proximate the beginning of the rump and thigh portion to form a convex (at its lower edge) rocker side panel 17. A further shallow concavely curved (at its lower edge) portion 18 leading to the tip end 19 of the leg and foot supporting panel portion 13. This side panel configuration is likewise well known in the art. It will be appreciated that the space SP may be filled in, if desired, by side panel material but this is not necessary. A runner member 20 is integrally molded to the lower edge of each side panel and, according to the present invention, and as shown in FIG. 4, the runner is gradually thickened in the area of the concave rocker side panel from a thickness T1 to a thickness T2 and then gradually back to a thickness T1 to modify the radius of curvature thereof and, at the same time, to substantially thicken and reinforce the runner portion where the most force or loading occurs at points tangential to the curvature of the rocker panel. Thus, the thickening shown in FIG. 4 serves a two-fold purpose, namely it changes the radius of curvature of the rocker panel to permit easier adjustments by shifting portions of the body such as the arms and head to permit the shifting of the position of the rocker from a reclining position to a substantially sitting position as shown in FIGS. 5 and 6, respectively. In addition, this added material which gradually modifies the radius of curvature at the points of most loading on the rocker panel runners 20 by the loading transmitted along tangential points along that curvature. Such loading can cause significant wear when the panel is used on concrete or sandy surfaces, etc. such as at the beach or at pool sides and thereby tends to cause excessive wear and deterioration of the recliner in these areas. The added thickness strengthens and protects the runner and side panels at these points of heavy loading, particularly in the reclining positions, since in the position shown in FIG. 2, tip 19 bears on the support surface.

As also shown in FIG. 1, an opening 21A and a further opening 21T at the respective head and foot ends of the recliner are provided hand-holds for easy handling of the unit. A series of elongated slots or holes 23HT, and 24LF are also provided. These slots or holes provide additional hand-holds if needed and also serve to lighten the weight of the unit. Moreover, they can be adapted to provide holes for pad straps (in addition or as an alternative to VELCRO fasteners disclosed later herein), and provide a decorative design. In other words, these can be used to personalize the chair. In addition, if desired, an decal or insert DI (FIG. 7) may be utilized to show that the person is a fan of wrestling, boxing, football, swimming, hunting, etc. or any other sport or any other activity. Moreover, these holes provide breathing holes and thereby make the unit cooler to use so that any instant breeze will be caught in either position whether reclining or sitting. Finally, these slots and holes allow the unit to drain-dry easier and because of the conjunction of the slots, permit breezes to flow through the unit and thereby enhance the drying thereof.

As shown in FIGS. 2 and 3, the side panels 14, 15 may also be provided with hand-holds 31H and 31F. Also shown in FIGS. 2 and 3 are a pair of gimbal or swivel mounted cup, can or ashtray holders 34, 35 are mounted on a swivel or gimballed mounts 36, 37 respectively, so that regardless of whether the unit is being used as a chair (FIG. 2) wherein the rocker panel runner portion 22GE and the tip end 19 are both engaged with the ground, or only when the ground engaging runner 22GE is in the area of the concave rocker side panel is contacting the ground and the tip and leg portion are elevated at different elevations. In each case, the cup or ashtray holder pivots or swivels relative to the side panel 17 to maintain verticality of the cup holder or ashtray 36, 37. The swivels or gimbals may be adhesively secured to the side panels 17 or be secured by rivets or molded in securement fittings.

As shown in FIG. 2 and dotted in FIG. 1, a U-shaped brace member 40 extends between the side panels at the rump supporting portion of the rump and thigh panel portion 12 and this likewise is well known in the art. Drain holes (not shown) may be provided in the U-shaped panel supporting member and a drain hole DH is shown in the rump supporting portion. However, it will be appreciated that the U-shaped member may be provided with a foam filling FF and thereby serve as flotation along with flotation at the head (see FIG. 1) and foot portions so as to balance the unit and permit the unit to be used as a floating rocker recliner.

In FIG. 7, a pillow or head pad HP is shown secured to the rocker recliner at the head and torso portion 11 by means of either straps or, as shown in FIG. 8, a VELCRO fastener 50, there being a corresponding complementary VELCRO fastener VF adhesively secured on the head and torso panel 11 and a cooperating velcro connector on the back of the pad HP.

The dimensions shown in the drawings are exemplary and are deemed to be part of the prior art.

It will be appreciated that when the unit is to incorporate foam between the side panels so as to permit the rocker chaise of this invention to be utilized as a floating chaise, more foam will be located in the head torso panel portion 11 so as to always maintain the head above water.

The basic structure is preferably molded of fiberglass because of its strength and resistance to fracturing and cracking but both forms of plastic may be used and even light weight aluminium may be used to form the basic unit. In addition, a gel coat of a light smooth coating may be applied to the fiberglass coating so as to maintain a smoothness on the surface and provide easy cleanability. However, as noted above, low cost plastic molded structures are within the scope of the invention.

The thickened rocker panel improves the balance between sitting and reclining position while permitting easier adjusting to or from the reclining-sitting position just by shifting the arms or legs, and it strengthens the unit, lengthens the life and make it easier to use.

The hand-holds as well as the slotted openings make the unit lighter in weight, easier to dry-out and much more amenable to decorative designs for personalizing and, at the same time, the unit becomes air breathable and hence cooler to use.

While there has been shown and described a preferred embodiment of the invention, it will be appreciated that other embodiments and adaptations thereof will be apparent to those skilled in the art and it is intended to cover such obvious modifications and adaptations within the spirit and scope of the claims appended hereto.

What is claimed is:

1. In a molded reclining chair having a continuous one-piece body support panel, said body support panel having a head and torso supporting panel portion smoothly joined to a rump and thigh supporting panel portion which, in turn, is smoothly connected to a leg and foot supporting panel portion, said leg and foot supporting portion being joined to said rump and thigh supporting panel portion at an obtuse angle ($\theta$), said head and torso panel portion being joined to said rump and thigh panel portion at an angle approaching about 80 to 110 degrees, a pair of depending side rocker panels beginning at the outermost tip end of said head and torso panel portion and one each extending along the sides of said panel portions to smoothly and curvingly diverge from said outermost tip to proximate the beginning of said rump and thigh portion to form a convex rocker side panel, a further shallow concavely curved portion leading to the tip end of said leg and foot supporting panel portion, runner means integrally molded to the lower edge of each of said side panels, the improvements comprising means molded with said runner means to gradually thicken said runner means in the area of said convex rocker side panel from a thickness T1 to a thicker thickness T2 and gradually modify the radius of curvature thereof, and means forming openings to constitute at least one hand-hold in at least one of said panels, and fastener means secured to selected ones of said panel for the securement of a pad on at least one of said head and torso supporting panel and leg coacting fastener means, and a swivel mounted drink container support means secured to the depending portion of one of said pair of side panels and at a location such that any container supported thereby does not engage the ground at any position and is maintained in a vertical position thereby.

2. In a molded reclining chair having a continuous one-piece body support panel, said body support panel having a head and torso supporting panel portion smoothly joined to a rump and thigh supporting panel portion which, in turn, is smoothly connected to a leg and foot supporting panel portion, said leg and foot supporting portion being joined to said rump and thigh supporting panel portion at an obtuse angle ($\theta$), said head and torso panel portion being joined to said rump and thigh panel portion at an angle approaching about 80 to 110 degrees, a pair of depending side rocker panels beginning at the outermost tip end of said head and torso panel portion and one each extending along the sides of said panel portions to smoothly and curvingly diverge from said outermost tip to proximate the beginning of said rump and thigh portion to form a convex rocker side panel, a further shallow convexly curved portion leading to the tip end of said leg and foot supporting panel portion, runner means integrally molded to the lower edge of each of said side panels, the improvement comprising means molded with said runner means to gradually thicken said runner means in the area of said concave rocker side panel from a thickness T1 to a thickness T2 and gradually change the radius of curvature thereof.

3. The molded reclining chair defined in claim 2 including one or more swivel mounted container supports mounted on said side panels at a location such that any container carried thereby does not engage the ground and is maintained in a vertical position thereby.

4. The molded reclining chair defined in claim 2 including one or more hand-holds openings formed therein.

5. The molded reclining chair defined in claim 2 including one or more fastener means for securing a pad to one or more of said panel portions, respectively.

6. The molded reclining chair defined in claim 1 including flotation means secured between said side panels and at locations such as to always maintain the head of the user above water.

7. A molded multi-position reclining chair having a continuous one-piece body support panel, said body support panel having a vented head and torso supporting panel portion smoothly and integrally joined to a rump and thigh supporting panel portion which, in turn, is smoothly and integrally connected to a vented leg and foot supporting panel portion, said leg and foot supporting portion being joined to said rump and thigh supporting panel portion at an obtuse angle ($\theta$), said vented head and torso panel portion being joined to said rump and thigh panel portion at an angle approaching about 80 to 110 degrees, said vented head and torso supporting panel portion having a plurality of vent holes formed in a pattern therein to permit air to flow to a user's head and torso and reduce the weight of said chair without significantly impairing its strength, a pair of depending side rocker panels beginning at the outermost tip end of said head and torso panel portion and one each extending along the sides of said panel portions to smoothly and curvingly diverge from said outermost tip to proximate the beginning of said rump and thigh portion to form a convex rocker side panel, a further shallow concavely curved portion leading to the tip end of said leg and foot supporting panel portion, runner means integrally molded to the lower edge of each of said side panels, and means forming openings to constitute at least one hand-hold in at least one of said panels, fastener means secured to selected ones of said body support panel portions for the securement of a pad on at least one of said head and torso supporting panel and coacting features means, and a swivel mounted drink container support means secured to the depending portion of one of said pair of side rocker panels and at a location such that any drink container supported thereby does not engage the ground at any position and is maintained in a vertical position by gravity.

8. A molded rocker reclining chair having a continuous one-piece body support panel, said body support panel having a vented head and torso supporting panel portion smoothly and integrally joined to a rump and thigh supporting panel portion which, in turn, is smoothly and integrally connected to a vented leg and foot supporting panel portion, said vented leg and foot supporting portion being joined to said rump and thigh supporting panel portion at an obtuse angle ($\theta$), said vented head and torso panel portion being joined to said rump and thigh panel portion at an angle approaching about 80 to 110 degrees, means forming a plurality of vent holes in a predetermined pattern over a substantial area of at least one of said vented head and torso panel portion and said leg and foot supporting portion, a pair of vertical depending side rocker panels integrally joined to said one-piece body support panel beginning at the outermost tip end of said head and torso panel portion and one each extending along the sides of said panel portions to smoothly and curvingly diverge from said outermost tip to proximate the beginning of said rump and thigh portion to form a convex rocker side panel, a further shallow concavely curved portion leading to the tip end of said leg and foot supporting panel portion, runner means integrally molded to the lower edge of each of said side panels.

9. The molded reclining chair defined in claim 8 including one or more swivel mounted container supports mounted on said side panels at a location such that any container carried thereby does not engage the ground and is maintained in a vertical position thereby at any position of said rocker recliner chair.

10. The molded reclining chair defined in claim 8 including one or more hand-hold openings formed therein.

11. The molded reclining chair defined in claim 8 including one or more loop and hook fastener means for securing a pad to one or more of said panel portions, respectively.

12. The molded reclining chair defined in claim 8 including flotation means secured between said side panels and at locations such as to always maintain the head of the user above water.

13. The molded reclining chair defined in claim 8 including at least one swivel mounted container support and means mounting said swivel mounted container support on said vertical concave rocker side panel.

14. A molded multi-position sitting and reclining chair having a continuous one-piece body support panel, said body support panel having a head and torso supporting panel portion smoothly and integrally joined to a rump and thigh supporting panel portion which, in turn, is smoothly and integrally connected to a leg and foot supporting panel portion, said leg and foot supporting portion being joined to said rump and thigh supporting panel portion at an obtuse angle ($\theta$), said head and torso panel portion being joined to said rump and thigh panel portion at an angle approaching about 80 to 110 degrees, a pair of depending side rocker panels beginning at the outermost tip end of said head and torso panel portion and one each extending along the sides of said panel portions to smoothly and curvingly diverge from said outermost tip to proximate the beginning of said rump and thigh portion to form a convex rocker side panel, a further shallow concavely curved portion leading to the tip end of said leg and foot supporting panel portion, runner means integrally molded to the lower edge of each of said side panels, including means for improving the balance between sitting and reclining positions permitting easier shifting of said chair from a reclining position to a sitting position and vice versa and reinforcing said runners at said convex rocker side panel against excessive wear by concrete and sandy surfaces, and means forming a hand-hold in said side panels.

15. The molded reclining chair defined in claim 14 including fastener means secured to said head and torso supporting panel for releasably securing a pad to said head and torso panel.

16. The molded rocker defined in claim 14 including a swivel mounted holder secured to one of said depending side rocker panels.

17. The molded rocker reclining chair defined in claim 14 wherein said hand hold means is formed on said side rocker panels in said further shallow concavely curved portion.

18. A one-piece molded rocker recliner chair for use on concrete and sandy surfaces comprising a continuous body support panel, said continuous body support panel having a head and torso supporting portion smoothly and integrally joined at a first predetermined angle, to a rump and thigh supporting portion, in turn is smoothly and integrally joined to a leg and foot supporting portion at a second predetermined angle, a pair of depending side panels, one at each side of said continuous body support panel, respectively, said depending side panels having a convexly curved lower edge extending from said head and torso supporting portion to proximate the beginning of said rump and thigh portion, runner means on said convexly curved lower edge, including means providing an improved balance between sitting and reclining positions while permitting easier adjusting to or from reclining and sitting positions, respectively, by shifting the arms or legs of a user and reinforcing said runner means from wear where the most pressure on concrete and sandy surfaces occurs at points tangential to said convexly curved lower edge.

* * * * *